US009409098B2

(12) United States Patent
Blackham

(10) Patent No.: US 9,409,098 B2
(45) Date of Patent: Aug. 9, 2016

(54) AERODYNAMIC BOARD FOR FINGERS TOY

(71) Applicant: Brian Blackham, Salt Lake City, UT (US)

(72) Inventor: Brian Blackham, Salt Lake City, UT (US)

( * ) Notice: Subject to any disclaimer, the term of this patent is extended or adjusted under 35 U.S.C. 154(b) by 0 days.

(21) Appl. No.: 14/558,370

(22) Filed: Dec. 2, 2014

(65) Prior Publication Data

US 2015/0202539 A1 Jul. 23, 2015

Related U.S. Application Data

(60) Provisional application No. 61/910,531, filed on Dec. 2, 2013.

(51) Int. Cl.
*A63H 33/00* (2006.01)
*A63H 23/00* (2006.01)

(52) U.S. Cl.
CPC ..... *A63H 23/00* (2013.01)

(58) Field of Classification Search
USPC ..... 446/26, 61, 153, 176, 179, 199, 34, 491
See application file for complete search history.

(56) References Cited

U.S. PATENT DOCUMENTS

| | | | | |
|---|---|---|---|---|
| 4,923,427 | A * | 5/1990 | Roland | A63H 23/00 114/140 |
| 4,938,698 | A * | 7/1990 | Chantry | A63B 69/18 434/253 |
| 6,431,943 | B1 * | 8/2002 | Rehkemper | A63H 17/16 446/440 |
| 6,540,577 | B1 * | 4/2003 | Nelson | A63H 33/00 446/129 |
| 7,931,519 | B2 * | 4/2011 | Fox | A63H 17/25 280/87.042 |
| 8,113,895 | B2 * | 2/2012 | Watanabe | B29C 67/0055 114/357 |
| 8,123,050 | B2 * | 2/2012 | Carrillo | A47F 7/00 211/85.7 |
| 2010/0216368 | A1 * | 8/2010 | Del Principe | A63H 33/40 446/179 |

OTHER PUBLICATIONS

Ralph Pernot, "Finger Surf" (YouTube video uploaded Sep. 4, 2011, https://www.youtube.com/watch?v=2PJsX7h4uWI) [retrieved online Sep. 8, 2015].*

"Fingersurfing" by House of Lotz (published Jul. 28, 2013, https://www.kickstarter.com/projects/917665757/fingersurfing/description) [retrieved online Sep. 8, 2015].*

* cited by examiner

*Primary Examiner* — Kurt Fernstrom
(74) *Attorney, Agent, or Firm* — Terrence J. Edwards; TechLaw Ventures, PLLC

(57) ABSTRACT

The disclosure extends to methods, systems, and devices for producing a realistic scaled fingertip surfing experience.

19 Claims, 10 Drawing Sheets

AERODYNAMIC BOARD FOR FINGERS TOY

CROSS-REFERENCE TO RELATED APPLICATIONS

This application claims the benefit of U.S. Provisional Application No. 61/910,531, filed Dec. 2, 2013, which is hereby incorporated by reference herein in its entirety, including but not limited to those portions that specifically appear hereinafter, the incorporation by reference being made with the following exception: In the event that any portion of the above-referenced application is inconsistent with this application, this application supercedes said above-referenced application.

STATEMENT REGARDING FEDERALLY SPONSORED RESEARCH OR DEVELOPMENT

Not Applicable.

BACKGROUND

This disclosure relates generally to finger toys, and more particularly, but not necessarily entirely, to an aero dynamic board for use with fingers toy.

A variety of hand held and hand used toys that mimic large full scale items have become popular. However, most of these toys fail to recreate the desired scaled realistic experience.

As disclosed herein below, the disclosure provides an apparatus, system and method for finger surfing such that the hand can operate much like a human body on a surf board riding a wave of air in an efficient, effective and elegant manner.

What is needed is an apparatus, system and methods that are efficient in creating a scaled but realistic experience of surfing for a user. As will be seen, the disclosure provides such an apparatus, system and method.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like which has been included in the present specification is not to be taken as an admission that any or all of these matters form part of the prior art base, or were common general knowledge in the field relevant to the disclosure as it existed before the priority date of each claim of this application.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure extends to methods, systems, and devices for producing a realistic aerodynamic toy experience. In the following description of the disclosure, reference is made to the accompanying drawings, which form a part hereof, and in which is shown by way of illustration specific implementations in which the disclosure may be practiced. It is understood that other implementations may be utilized and structural changes may be made without departing from the scope of the disclosure.

Before the methods, systems and devices for producing a realistic aero board experience are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

As used herein, the terms "aero board" and/or "finger board" refer broadly to the large family of scaled down surf like toys made from the suitable materials and shapes to act predictably in fluids such as air.

Referring now to the figures, where a toy air surfing device and system for producing a realistic surfing experience for fingers are illustrated. An implementation of an aero board for fingers may comprise:

a board portion having a top surface and a bottom surface wherein the bottom surface comprises an opening there through, and wherein the top surface comprises:

a gripping surface configured to grip finger tips, and wherein the board further comprises a cord attachment opening for attaching a cord to a board at a first end and finger strap at a second end.

Figure 1:
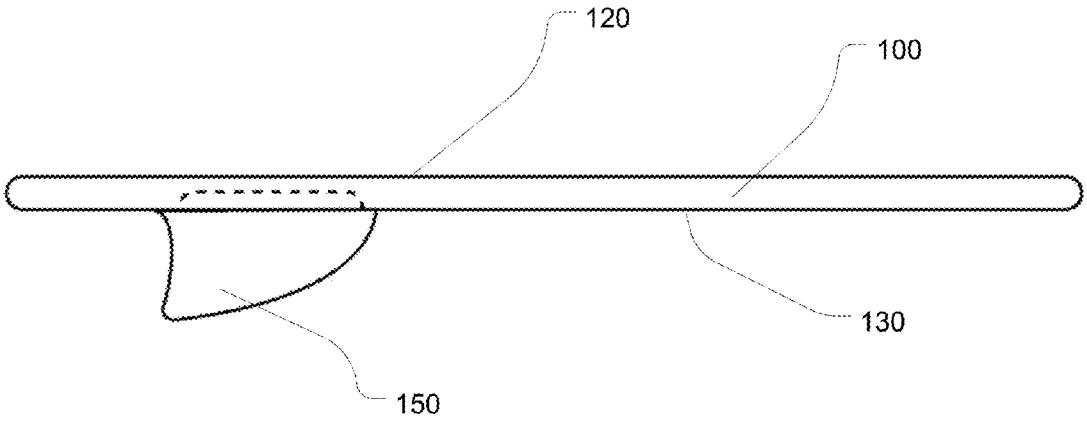
FIG. 1 illustrates an implementation of an aerodynamic board device for producing a scaled realistic experience in accordance with the teachings and principles of the disclosure.

FIG. 1 illustrates a side view of an implementation of an aero finger board. As can be seen in the figure an aero finger board may comprise a board portion 100 having a top surface 120 and a bottom surface 130, wherein the top surface 120 is configured to interact with fingers while the bottom surface 130 is configured to work with air flow in aerodynamic communication with passing air. Additionally, the bottom surface 130 may further comprise a fin 150, or a plurality of fins. The fin 150 may be detachable and re-attachable within openings in the bottom surface 130 for customization, or travel packing and packaging. The body of the board may be made of any suitably light and rigid material that will produce the desired experience. For example, the body may be formed from polymeric and/or wood.

Figure 2:
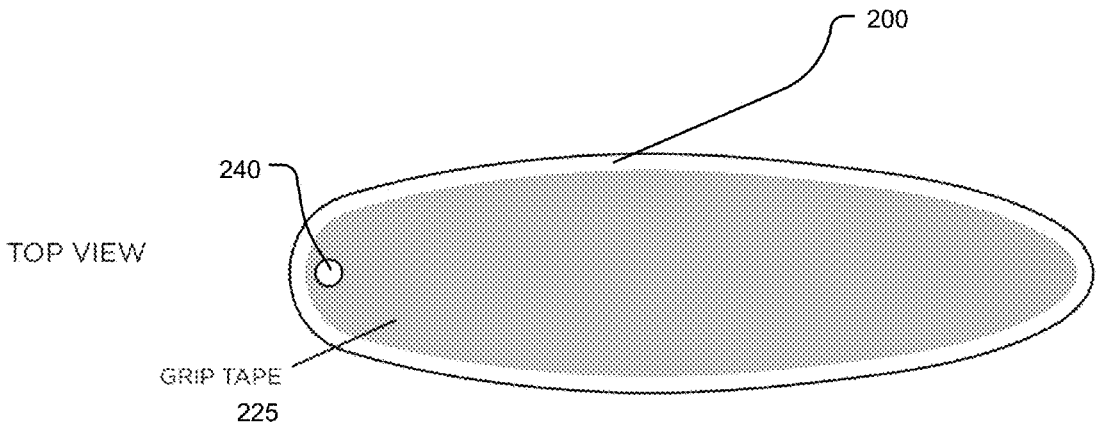
FIG. 2 illustrates an implementation of an aerodynamic board device for producing a scaled realistic experience in accordance with the teachings and principles of the disclosure.
Figure 5:
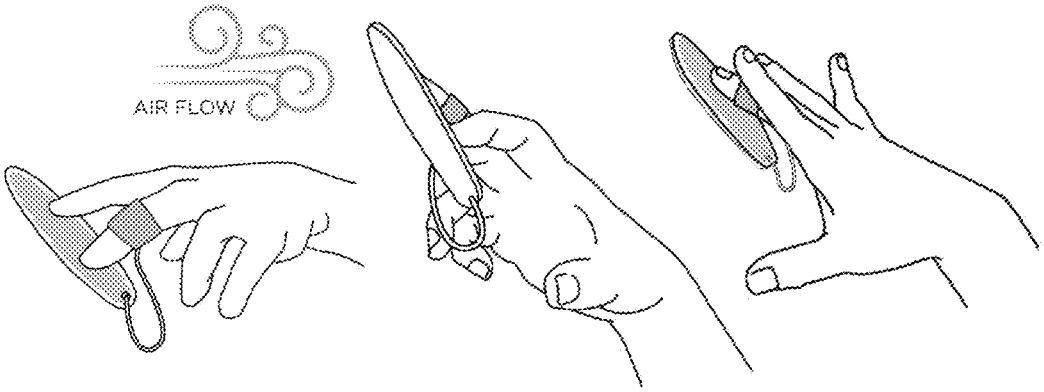
FIG. 5 illustrates an implementation of an aerodynamic board device for producing a scaled realistic experience in accordance with the teachings and principles of the disclosure.

FIG. 2 illustrates a top view of an implementation of an aero finger board. As can be seen in the figure an aero finger board may comprise a board portion 200 having a top surface 220, wherein the top surface 220 is configured to interact with fingers while a bottom surface is configured to work with air flow in aerodynamic communication with passing air. The top surface 220 may comprise a gripping surface 225 configured to grip finger tips (as illustrated in FIG. 5). The griping surface may be made from any material that would provide additional grip to the material making up the body of the board 200. The board may further comprise a cord attachment opening 240 for attaching a cord (as illustrated in FIG. 3) to a board at a first end and finger strap at a second end.

Figure 3:
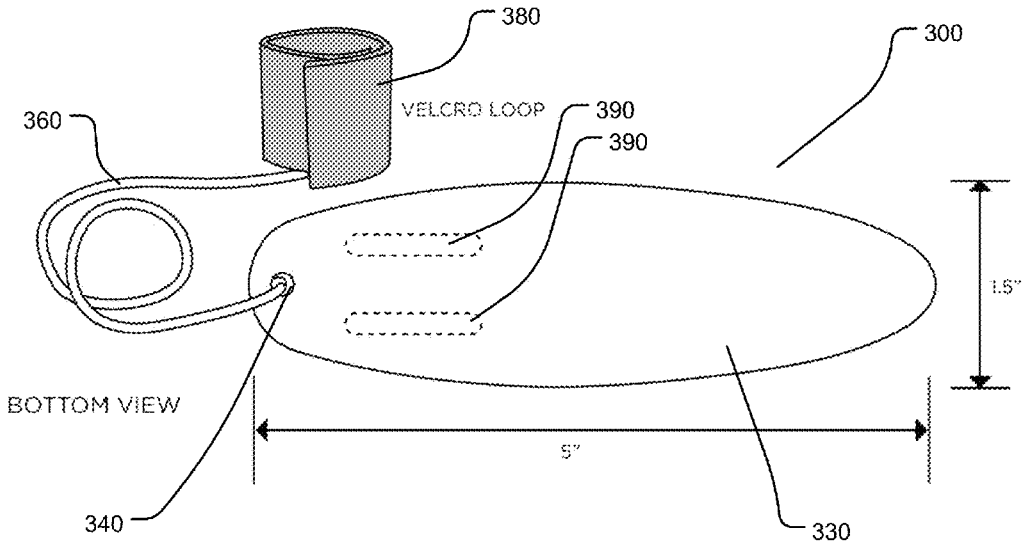
FIG. 3 illustrates an implementation of an aerodynamic board device for producing a scaled realistic experience in accordance with the teachings and principles of the disclosure.

FIG. 3 illustrates a view of an implementation of an aero finger board system having a finger attachment strap. As can be seen in the figure an aero finger board may comprise a board portion 300 having a top surface, wherein the top surface is configured to interact with fingers while a bottom surface 330 is configured to work with air flow in aerodynamic communication with passing air. The top surface may comprise a gripping surface configured to grip finger tips (as illustrated in FIG. 5). The griping surface may be made from any material that would provide additional grip to the material making up the body of the board 300. The board 300 may further comprise a cord attachment opening 340 for attaching a cord 360 to a board at a first end and finger strap 380 at a second end. Additionally, the bottom surface 330 may further comprise a fin opening 390, or a plurality of fin openings 390 for detachably receiving stabilizing fins therein. The fins may be configured to be detachable and re-attachable within the openings 390 in the bottom surface 330 for customization or packing and packaging.

In an implementation, the finger strap 380 may be configured for attaching to a finger of the user and my comprised fastening structures such as for example Velcro, adhesives, snaps etc. The cord 360 may be made of any suitable material strong enough to retain the board 330 once it leaves the fingertips of the user to prevent losing the board 300. Additionally, the strap may be made of an elastic material. It should be noted that the dimensions shown in the figures are intended to indicate a general scale that the apparatus may take. It is not intended that dimensions shown be limiting to those substantially exact dimensions, however an aerodynamic toy made to be used with fingers may substantially five inches by one and half inches for ease of use. It will be appreciated that varying sizes may be desired to account for user hand size and the expected air flow that may be expected.

Figure 4:
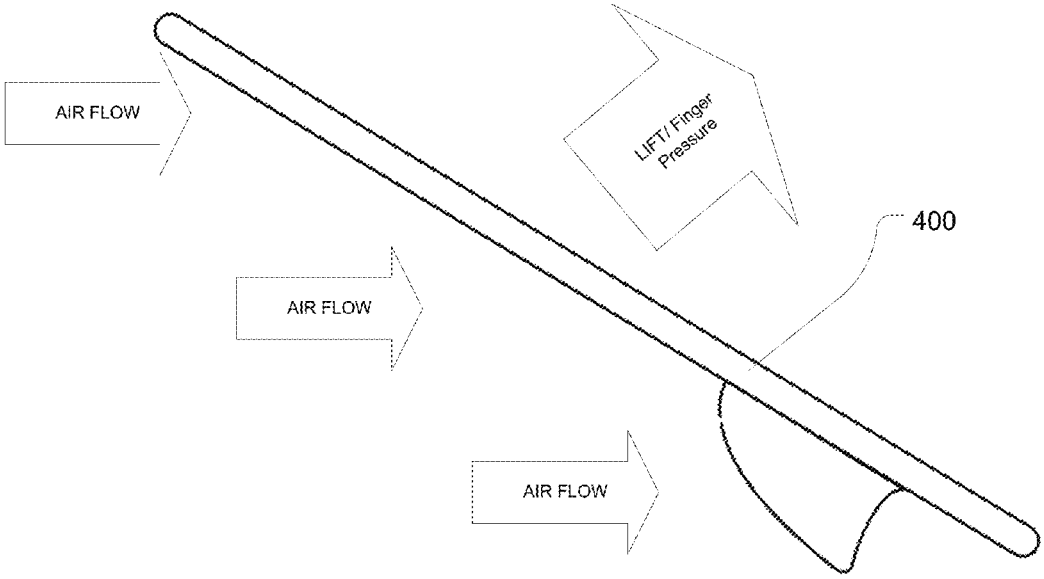
FIG. 4 illustrates an implementation of an aerodynamic board device for producing a scaled realistic experience in accordance with the teachings and principles of the disclosure.

Illustrated in FIG. 4 is an airflow diagram for the aero dynamic toy. As can be seen in the figure, lift is created and generates pressure against a user's fingertips as air flow passes over and around the bottom of the board 400. Additionally, direct air pressure acts on the bottom surface of the board 400 to generate additional pressure against a user's fingertips.

FIG. 5 illustrates an implementation of an aerodynamic board toy in use. As seen in the figure, the board may be attached to a user via a cord and finger strap system. Additionally, the figure illustrates the ability to change finger position during use to perform tricks and otherwise control the board within an air flow.

Figure 6:
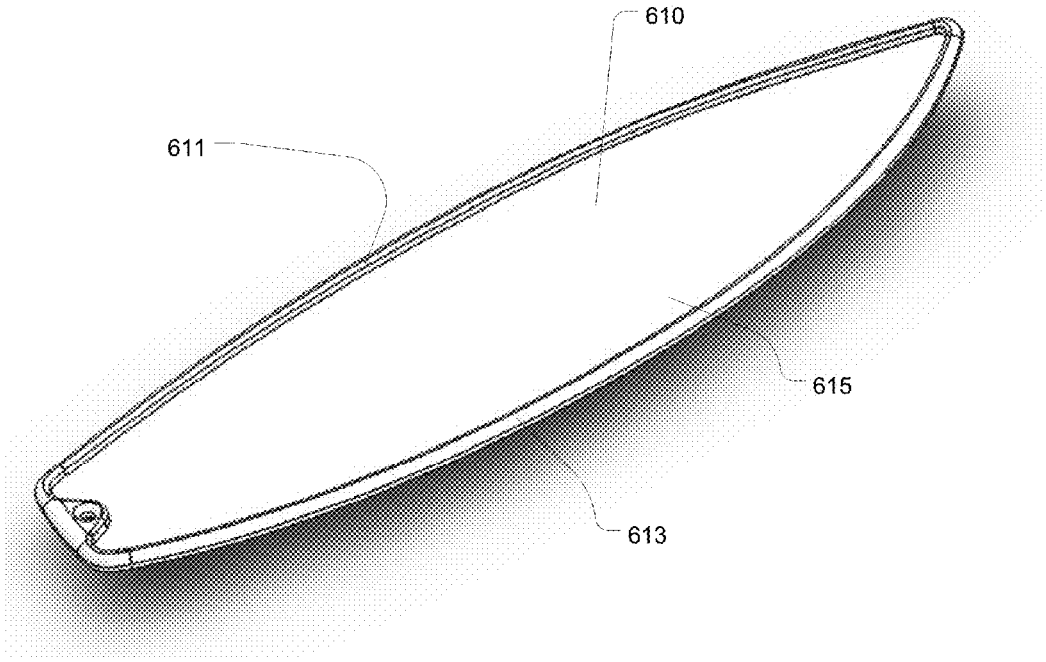
FIG. 6 illustrates an implementation of an aerodynamic board device for producing a scaled realistic experience in accordance with the teachings and principles of the disclosure.

FIG. 6 illustrates an embodiment of an aerodynamic board toy having a cavity disposed therein. A cavity 610 may be defined a wall 611, a bottom surface 615 and a top surface 613. A cavity may be desirable to reduce weight and mass of the aerodynamic board toy.

Figure 7:
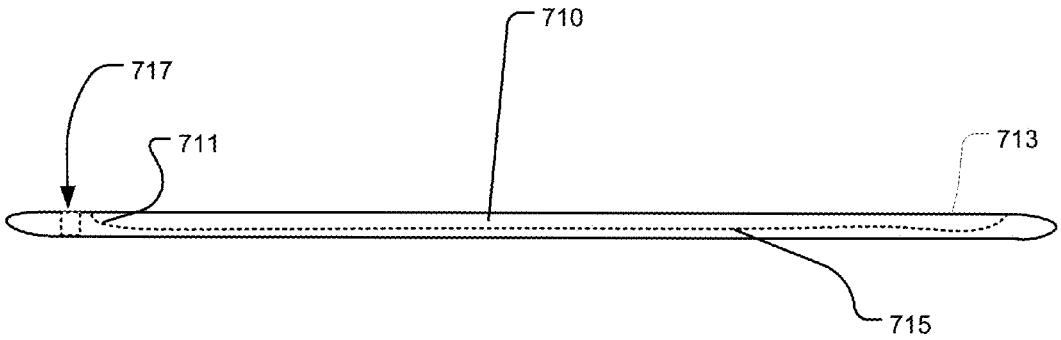
FIG. 7 illustrates a side view of an implementation of an aerodynamic board device for producing a scaled realistic experience in accordance with the teachings and principles of the disclosure.

FIG. 7 illustrates a side view of an embodiment of an aerodynamic board toy having a cavity disposed therein. A cavity 710 may be defined a wall 711, a bottom surface 715 and a top surface 713. Additionally, as can be seen in the figure a leash opening 717 may be provided for attaching a leash thereto so that the toy is not lost during use.

Figure 8:
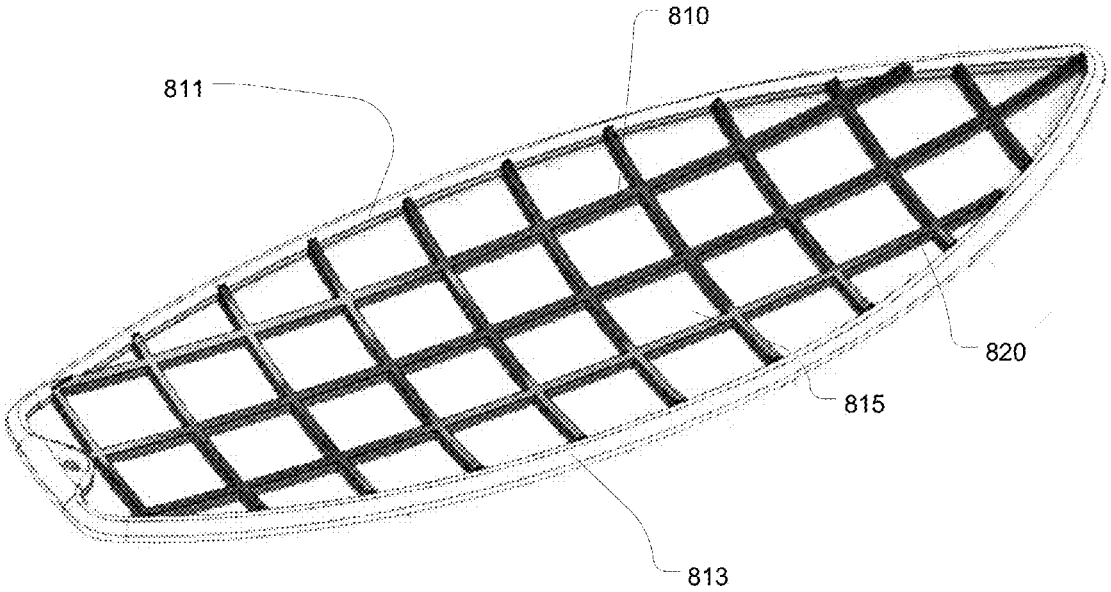
FIG. 8 illustrates an implementation of an aerodynamic board toy having a frame for producing a scaled realistic experience in accordance with the teachings and principles of the disclosure.

FIG. 8 illustrates an embodiment of an aerodynamic finger toy having a body with a cavity therein and a frame therein for added support. As can be seen in the figure, A cavity 810 may be defined a wall 811, a bottom surface 815 and a top surface 813, and disposed within the cavity 810 is a frame 820. The frame 820 may be unitary with the material that makes up the body of the aerodynamic toy. Alternatively the frame 820 may be made of a different material. In an implementation, the frame 820 may be molded with the body of the aerodynamic toy.

Figure 9:
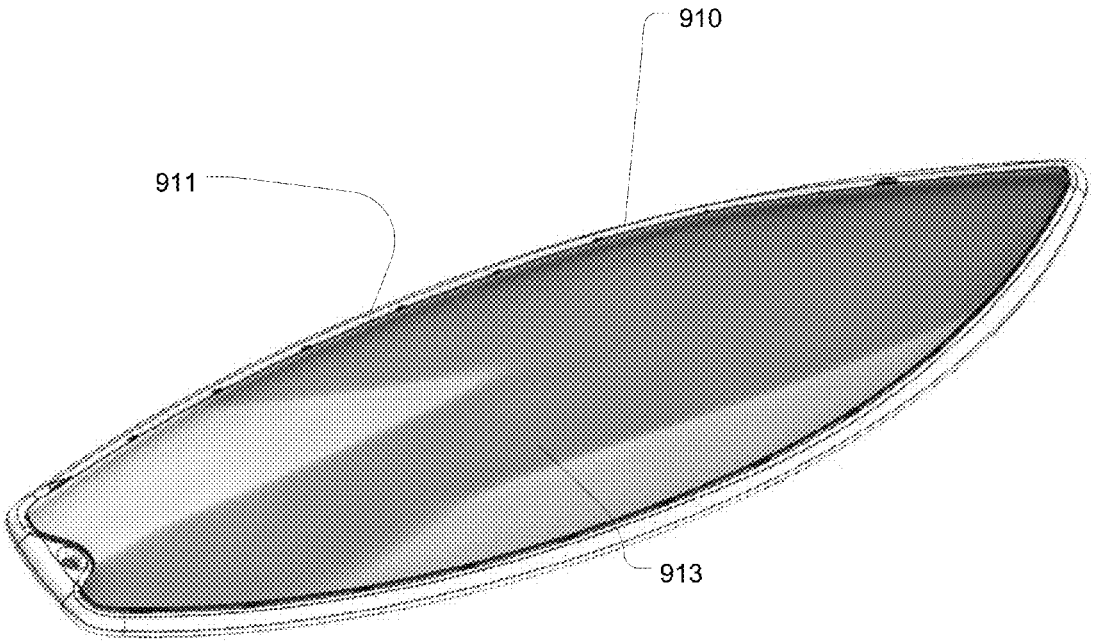
FIG. 9 illustrates an implementation of an aerodynamic board toy having a grip enhancing top for producing a scaled realistic experience in accordance with the teachings and principles of the disclosure.

FIG. 9 illustrates an embodiment of an aerodynamic finger toy 900 having grip increasing top surface thereon. As illustrated in the figure, a grip tape layer 913 may form the top surface of the toy 900. The grip tape 913 may be sized to fit within a cavity 910 formed within the body of the toy 900, wherein the cavity 910 and grip tape 913 are defined by a cavity wall 911. The grip tape may be made of sand paper of suitable grit or may be made with an adhesive that temporarily adheres to the fingertips of a user.

An implementation of an aero dynamic toy for use with moving air may comprise a body defined by a top surface, a bottom surface, and a wall surface defining a cavity within the body. The implementation may further comprise a frame disposed within the cavity and a grip tape disposed over the frame, wherein the body further comprises a leash opening that passes through the body from the top surface to the bottom surface. Additionally, the implementation may comprise a finger strap configured to attach to a finger of a user and a cord connecting the finger strap to the body.

Figure 10:
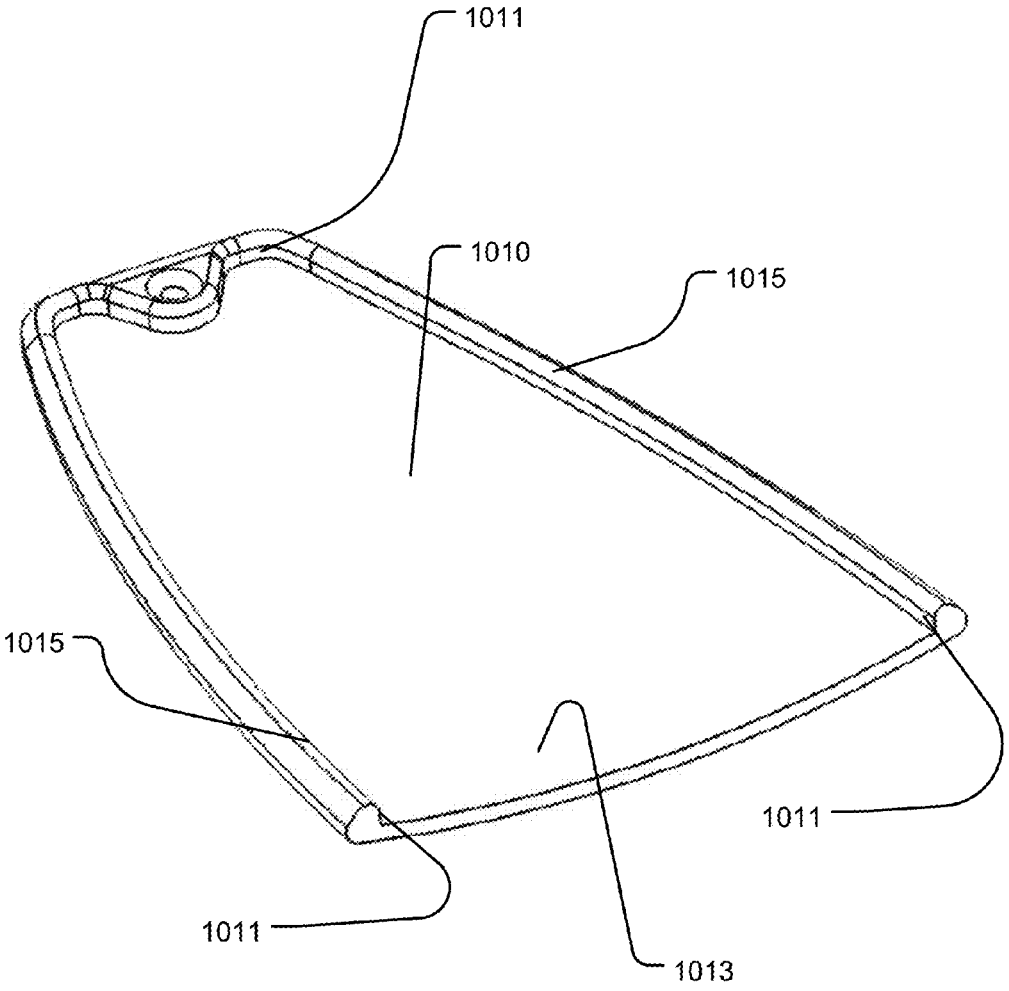
FIG. 10 illustrates a cutaway view of an implementation of an aerodynamic board toy for producing a scaled realistic experience in accordance with the teachings and principles of the disclosure.

FIG. 10 illustrates a cut-away view of an embodiment of an aerodynamic board toy having a cavity 1010 disposed therein. A cavity 1010 may be defined a wall 1011, a bottom surface 1013 and a top surface 1015. A cavity may be desirable to reduce weight and mass of the aerodynamic board toy. It should be noted that transitions between any of the surfaces may include rounding or chamfering in order to produce a desirably finished product.

The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

In the foregoing Detailed Description, various features of the disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims and future claims are hereby incorporated into this Detailed Description by this reference, with each claim standing on its own as a separate embodiment of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An aerodynamic toy for use with moving air comprising:

a body defined by a top surface, a bottom surface and a wall, wherein the wall comprises a cavity wall that extends above the top surface of the body and defining a cavity;

wherein the body further comprises a leash opening that passes through the body from the top surface to the bottom surface;

a finger strap configured to attach to a finger of a user;

a cord that runs through the leash opening and is attached to the body, thereby connecting the finger strap to the body; and a stiffener disposed within the cavity of the body of the toy, wherein the stiffener is attached to the body to provide stiffness to the body of the toy.

2. The toy of claim 1, wherein the stiffener comprises grip tape disposed on the top surface.

3. The toy of claim 1, wherein the finger strap comprises hook and loop fastening.

4. The toy of claim 1, wherein the finger strap comprises a snap fastener.

5. The toy of claim 1, wherein the finger strap is elastic.

6. The toy of claim 1, wherein the body is made of a polymeric material.

7. The toy of claim 1, wherein the body is made of wood that is hollowed out such that the cavity wall extends from the top surface of the body.

8. The toy of claim 1, wherein the stiffener comprises a plurality of supporting structures that comprise a frame, which is formed as a lattice structure.

9. The toy of claim 1, further comprising a fin disposed on the bottom surface.

10. An aerodynamic toy for use with moving air comprising:

a body defined by a top surface, a bottom surface, and a wall surface extending above the top surface and defining a cavity within the body;

wherein the body further comprises a leash opening that passes through the body from the top surface to the bottom surface;

a finger strap configured to attach to a finger of a user;

a cord that runs through the leash opening and is attached to the body, thereby connecting the finger strap to the body;

a stiffener disposed in the cavity within the body of the toy, wherein the stiffener is attached to the body to provide stiffness to the body of the toy.

11. The toy of claim 10, wherein the stiffener comprises grip tape disposed on the top surface.

12. The toy of claim 10, wherein the finger strap comprises hook and loop fastening.

13. The toy of claim 10, wherein the finger strap is elastic.

14. The toy of claim 10, wherein the body is made of a polymeric material.

15. The toy of claim 10, wherein the body is made of wood that is hollowed out such that the wall surface extends from the top surface of the body.

16. The toy of claim 10, wherein the stiffener comprises a plurality of supporting structures that comprise a frame, which is formed as a lattice structure.

17. The toy of claim 1, further comprising a fin disposed on the bottom surface.

18. An aerodynamic toy for use with moving air comprising:

a body defined by a top surface, a bottom surface, and a wall surface extending above the top surface and defining a cavity within the body;

a stiffener disposed within the cavity, wherein the stiffener is attached to the body to provide stiffness to the body of the toy, wherein the stiffener comprises a grip tape disposed on the top surface;

wherein the body further comprises a leash opening that passes through the body from the top surface to the bottom surface;

a finger strap configured to attach to a finger of a user; and a cord that runs through the leash opening and is attached to the body, thereby connecting the finger strap to the body.

19. The toy of claim 18, wherein the toy further comprises a frame that is unitary with the board material; and wherein a plurality of supporting structures comprise the frame and are formed as a lattice structure.

* * * * *